US009863610B2

(12) United States Patent
Duckworth

(10) Patent No.: US 9,863,610 B2
(45) Date of Patent: Jan. 9, 2018

(54) ROTATABLE SINGLE PIECE OPTICAL ARRAY

(71) Applicant: Hubbell Incorporated, Shelton, CT (US)

(72) Inventor: Jason Edward Duckworth, Simpsonville, SC (US)

(73) Assignee: Hubbell Incorporated, Shelton, CT (US)

( * ) Notice: Subject to any disclaimer, the term of this patent is extended or adjusted under 35 U.S.C. 154(b) by 180 days.

(21) Appl. No.: 14/863,735

(22) Filed: Sep. 24, 2015

(65) Prior Publication Data

US 2016/0084481 A1 Mar. 24, 2016

Related U.S. Application Data

(60) Provisional application No. 62/054,750, filed on Sep. 24, 2014.

(51) Int. Cl.

| | |
|---|---|
| ***F21V 17/02*** | (2006.01) |
| ***F21V 5/08*** | (2006.01) |
| ***F21V 5/00*** | (2015.01) |
| *F21V 5/04* | (2006.01) |
| *F21V 14/06* | (2006.01) |
| *F21W 131/10* | (2006.01) |
| *F21V 29/74* | (2015.01) |
| *F21Y 105/10* | (2016.01) |
| *F21Y 115/10* | (2016.01) |

(52) U.S. Cl.

CPC ..... *F21V 17/02* (2013.01); *F21V 5/007* (2013.01); *F21V 5/08* (2013.01); *F21V 5/04* (2013.01); *F21V 14/06* (2013.01); *F21V 29/74* (2015.01); *F21W 2131/10* (2013.01); *F21Y 2105/10* (2016.08); *F21Y 2115/10* (2016.08)

(58) Field of Classification Search

CPC . F21V 17/02; F21V 5/08; F21V 5/007; F21V 5/04; F21V 14/06; F21V 29/74; F21W 2131/10; F21Y 2105/10; F21Y 2115/10

See application file for complete search history.

(56) References Cited

U.S. PATENT DOCUMENTS

| | | | | |
|---|---|---|---|---|
| 6,502,956 | B1 * | 1/2003 | Wu | F21V 14/06 257/E25.028 |
| 8,061,868 | B2 * | 11/2011 | Dubord | B60Q 1/24 362/232 |
| 8,388,213 | B2 | 3/2013 | Yu | |
| 2014/0117386 | A1 | 5/2014 | Rol et al. | |

OTHER PUBLICATIONS

PCT/US2015/051980 International Search Report and Written Opinion dated Jan. 6, 2016.

* cited by examiner

*Primary Examiner* — David V Bruce
(74) *Attorney, Agent, or Firm* — Michael Best & Friedrich, LLP

(57) ABSTRACT

A lighting device includes a housing, a light emitting device, and an optical array. The housing has a base and the light emitting device is connected to the base for producing a light output. The optical array includes a lens and removably connects to the base. The optical array is repositionable on the base to modify the light output.

20 Claims, 8 Drawing Sheets

ROTATABLE SINGLE PIECE OPTICAL ARRAY

CROSS REFERENCE TO RELATED APPLICATION

This application claims the benefit under 35 U.S.C. §119 (e) of U.S. Provisional Application Ser. No. 62/054,750, filed Sep. 24, 2014, which is hereby incorporated by reference in its entirety.

FIELD

Various embodiments disclosed herein generally relate to the field of lighting and luminaires utilizing light emitting diodes (LEDs) to facilitate desired illumination. More particularly, embodiments provide optical components for use with one or more LED light sources, or arrays of such LED light sources, and luminaires incorporating such optical components and LED light sources. Further embodiments include methods of illumination where the configuration of respective optical components is field-adjustable to facilitate different desired light patterns emitted from the luminaire.

BACKGROUND

Recently, commercial, as well as residential, lighting applications have been transitioning to the use of LEDs where arrays of LEDs and LED modules provide illumination in applications such as street lighting, office building lighting, and many other outdoor and indoor applications.

LEDs perform well in the industry, but there are often problems related to aiming the light output from LEDs in a desired direction and pattern to illuminate a particular desired object or area. In general, LEDs emit light in all directions, away from the circuit board on which the LEDs typically reside. As a result, a significant amount of the emitted light is often times not directed towards the specific desired area of illumination.

SUMMARY

According to an exemplary embodiment, a lighting device includes a housing, a light emitting device, and an optical array. The housing has a base and the light emitting device is connected to the base for producing a light output. The optical array has a lens and removably connects to the base. The optical array is repositionable on the base to modify the light output.

According to another exemplary embodiment, an optical array includes a body portion and a plurality of lenses extending from the body portion. Each lens has a cavity for receiving a light emitter. The plurality of lenses combine to produce an asymmetric light output and the body portion is capable of being rotated to change the direction of the light output.

A further exemplary embodiment includes A method for altering the light emission pattern of an LED luminaire. An optical array is loosened from a housing of a luminaire. The luminaire has a light emitter with a first LED and a second LED. The optical array has a lens associated with the first LED. The optical array is rotated relative to the first and second LEDs. The first lens aligns with the second LED after the optical array is rotated. The optical array is connected to the housing.

BRIEF DESCRIPTION OF DRAWINGS

The aspects and features of various exemplary embodiments will be more apparent from the description of those exemplary embodiments taken with reference to the accompanying drawings, in which.

DETAILED DESCRIPTION OF EXEMPLARY EMBODIMENTS

Figure 1:
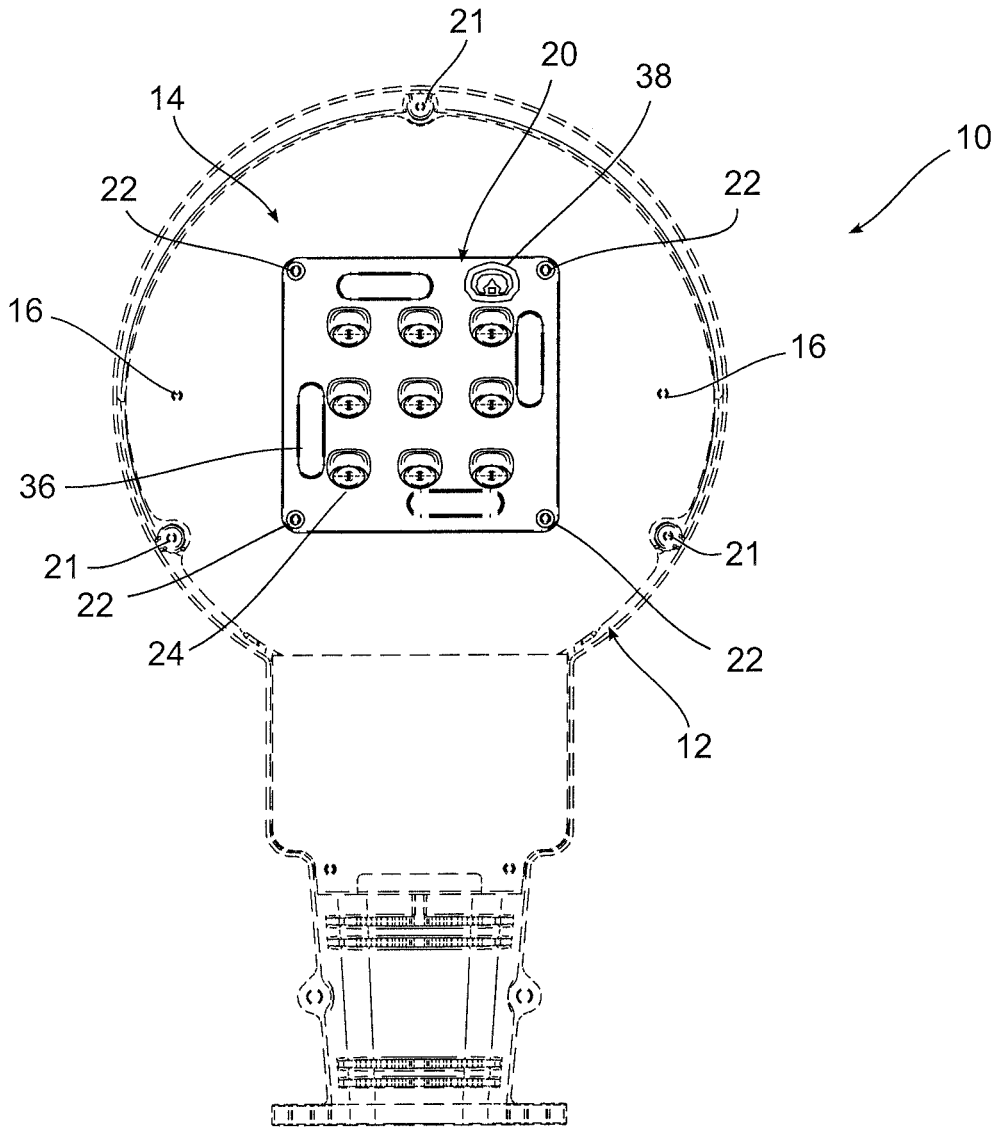
FIG. 1 is a bottom view of a lighting device including a rotatable optical array in accordance with an exemplary embodiment.

Referring to an exemplary embodiment shown in FIG. 1 a lighting device, or luminaire 10 includes a round light housing 12 having an upper portion made of heat conductive material such as aluminum or other appropriate material. A base 14 is connected to the upper portion by a fastener or other attachment mechanism, for example by two screws 16. In an exemplary embodiment the base 14 is a heat sink made of an appropriate heat conductive material sufficient to convey heat generated by LEDs 18 disposed on a printed circuit board under an optical array 20. The exemplary lighting device 10 is suitable for outdoor lighting applications where the luminaire can be mounted, for example, to a pole, the side of a building, or other structure, although features described herein can be incorporated into other types of lighting devices.

According to various exemplary embodiments, a secondary optic (not shown) could be installed to housing 12 by a fastener or other attachment mechanism. For example, three holes 21 are provided in housing 12 for receiving corresponding screws to attach a secondary optic, such as a diffuser, etc. Such a secondary optic also operates as a protection mechanism to protect the LEDs and optical array from damage caused by the environment.

The optical array 20 is connected to the base 14 by a fastener or other attachment mechanism, for example screws 22. As shown in the exemplary embodiment of FIG. 1, optical array 20 is formed as a unitary piece of material, such as acrylic or some other appropriate optic material. Lenses 24 are integrally formed with the body of the optical array 20 and each lens 24 corresponds to a respective LED 18. More particularly, each lens 24 directs the light generated by its corresponding LED 18 in a predetermined light pattern based on the specific design of the lens 24. An overall light pattern is then generated by the composite of all individual light patterns generated by the LEDs 18 and their respective lenses 24. The optical array 20 and integral lenses 24 can be made from a substantially clear or translucent material. The exemplary embodiment of FIGS. 1-11 show an optical array 20 with a substantially square configuration utilizing nine lenses 24. Other embodiments can utilize different sizes, shapes, and configurations of an optical array 20 having any number of lenses 24.

Figure 2:
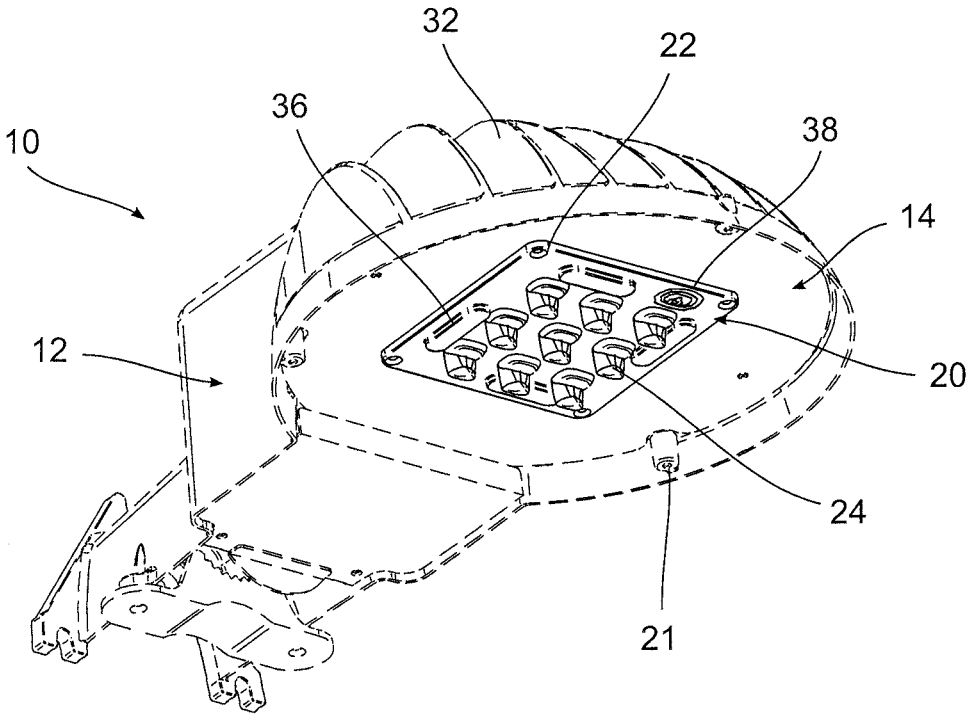
FIG. 2 is a bottom perspective view of the lighting device shown in FIG. 1.
Figure 3:
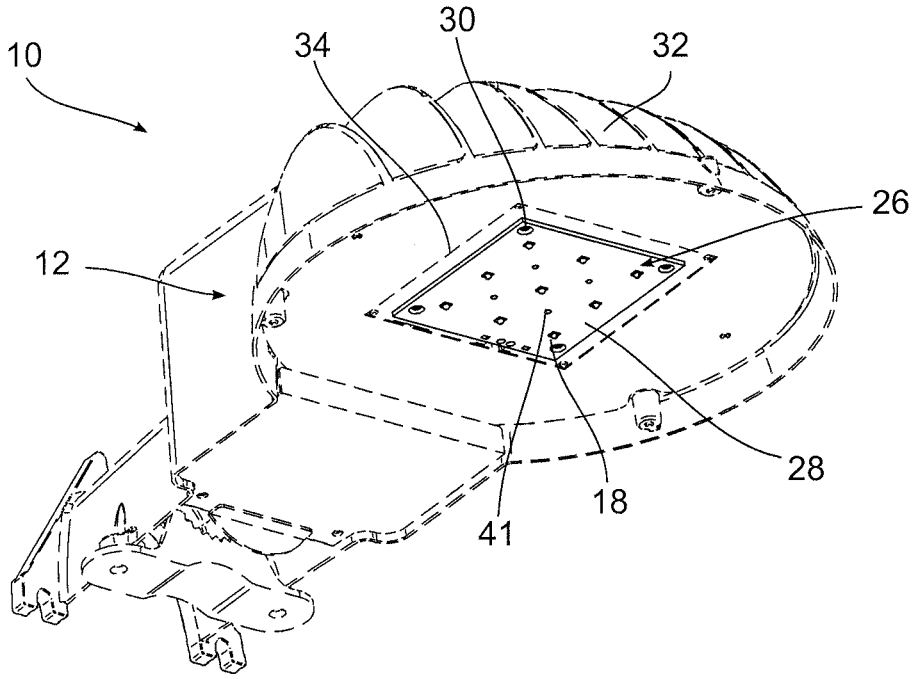
FIG. 3 is a bottom perspective view of the lighting device shown in FIG. 1 with the rotatable optical array removed.
Figure 4:
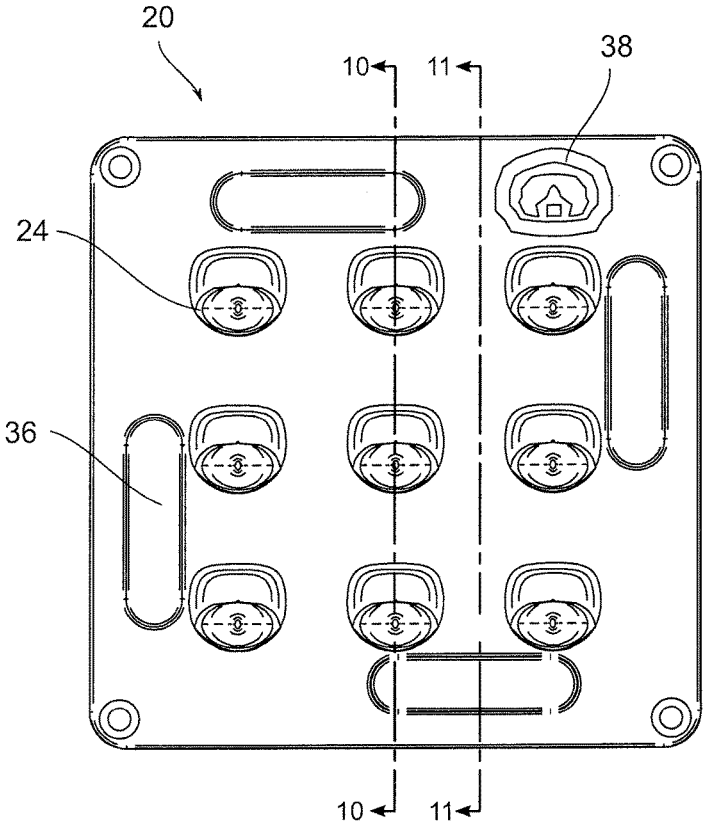
FIG. 4 is a top view of an optical array in accordance with an exemplary embodiment.
Figure 5:
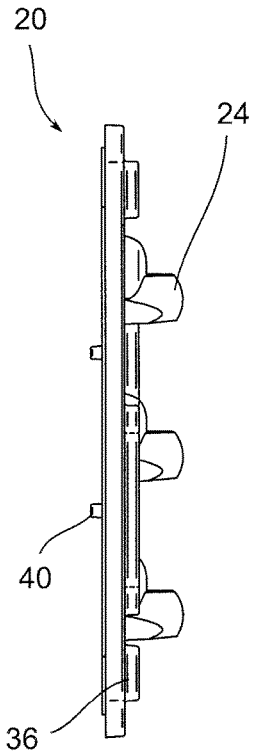
FIG. 5 is a side elevation view of the exemplary optical array of FIG. 4.
Figure 6:
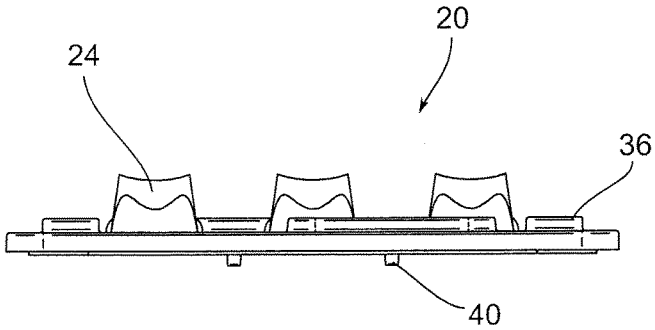
FIG. 6 is a front elevation view of the exemplary optical array of FIG. 4.

FIG. 3 shows the housing 12 with the optical array 20 removed, exposing the light emitting device 26. In this exemplary embodiment, the light emitting device 26 is a plurality of LEDs 18 mounting on a printed circuit board (PCB) 28. The PCB 28 is mounted to the base 14 base by one or more mechanical fasteners, for example four screws 30. Heat generated by LEDs 18 is conducted to the base 14 and housing 12 where it is dissipated. As best shown in FIGS. 2 and 3, the housing 12 includes heat fins, or other structures, 32 which increase the surface area of the housing and provide effective heat dissipation by allowing air to pass through and around the fins 32. Dashed line 34 represents the outline of where optical array 20 would be mounted. Holes in the base 14 receive screws 22 when optical array 18 is installed.

FIGS. 4-11 show a rotatable optical array 20 in accordance with an exemplary embodiment. The optical array 20 includes nine lenses 24 arranged in a symmetrical 3×3 array of three rows and three columns. The optical array 20 also includes one or more clearance portions 36. Each clearance portion 36 encloses a respective area in which electrical wires, connections, or other components can reside without interfering with the bottom surface of the optical array 20. In an exemplary embodiment, the number of clearance portions 36 are equal to the number of sides of the optical array 20.

According to a further embodiment, an orientation marker 38 is provided on the face of optical array 20 to indicate a given initial orientation of the optical array when installed in a luminaire. For example, in the embodiment shown each lens 24 is formed such that the light emitted from the respective LEDs is directed generally towards, or in the same direction as, the orientation marker 38. Each lens 24 is also formed to spread the emitted light in an asymmetric pattern, discussed further below.

Under certain circumstances it may become desirable to modify the light pattern emitted from the luminaire 10. For example, a user could desire to change the positioning or direction of the emitted light without reconfiguring or removing the luminaire 10 or the light emitting device 24 which can include complicated structural and electrical modifications. According to various exemplary embodiments, the optical array 20 can be rotated on the base 14 to allow a user to easily modify the light output.

To rotate the light pattern, optical array 20 is adjusted within or removed from the luminaire 10, for example, by unscrewing screws 22 which are securing the optical array 20 to the base 14, and rotating the optical array by 90 degrees. Indexing posts 40 align with corresponding holes 41 in the PCB 28 to assist in aligning the optical array 20 to the PCB 28. For example, when indexing posts 40 mate with the corresponding indexing holes 41, each lens 24 aligns with a corresponding LED 16. Because the optical array 20 produces an asymmetric distribution, when the array is rotated, the light pattern also rotates.

Figure 7:
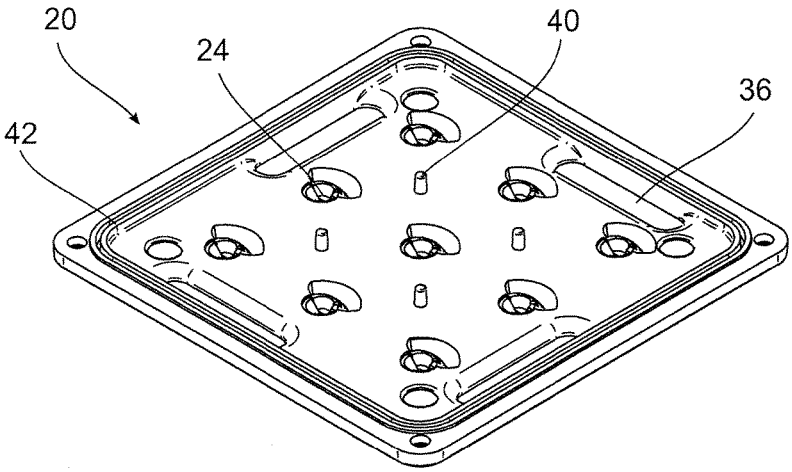
FIG. 7 is a bottom perspective view of the exemplary optical array of FIG. 4.
Figure 8:
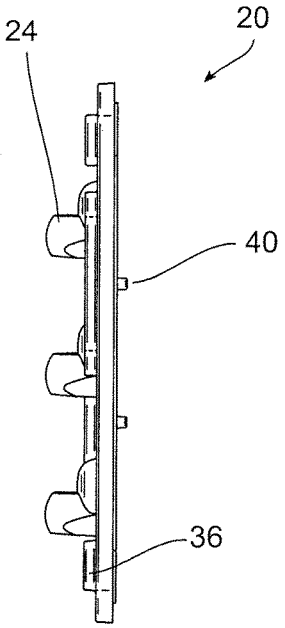
FIG. 8 is a side elevation view of the exemplary optical array of FIG. 4.
Figure 9:
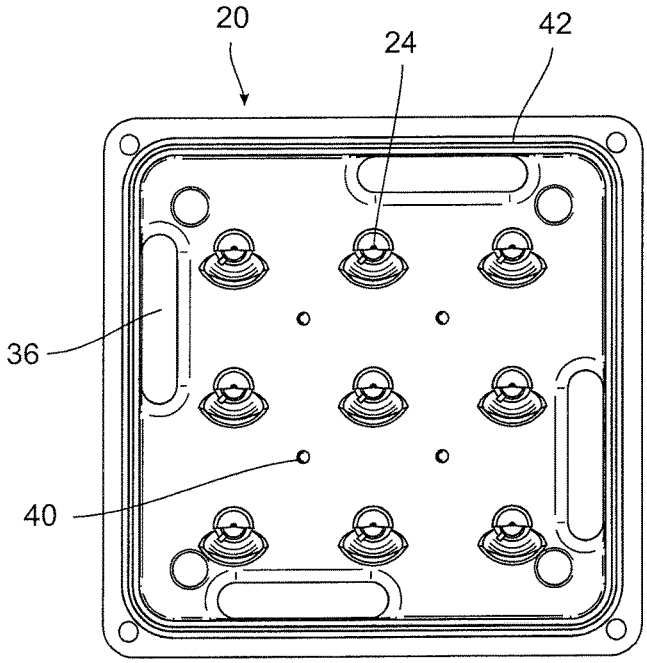
FIG. 9 is a bottom view of the exemplary optical array of FIG. 4.

FIGS. 7-9 illustrate the underside of the optical array 20 in accordance with an exemplary embodiment. As shown, a groove 42 is formed around the perimeter of optical array 20. A gasket made of rubber or other appropriate pliable material is placed within groove 42. When the underside of optical array 20 is placed in contact with the heat sink 14 and screws 22 are secured, a tight seal is formed by the gasket, resisting penetration of water and other foreign material within the area bounded by the gasket.

Figure 10:
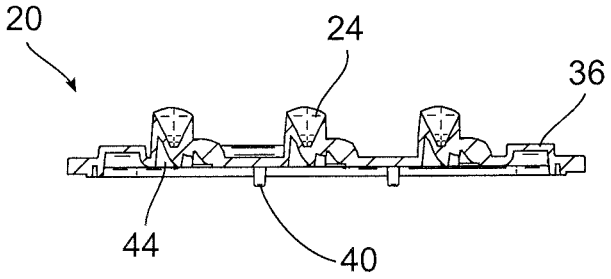
FIG. 10 is a sectional view of the optical array of FIG. 4 taken along line 10-10.
Figure 11:
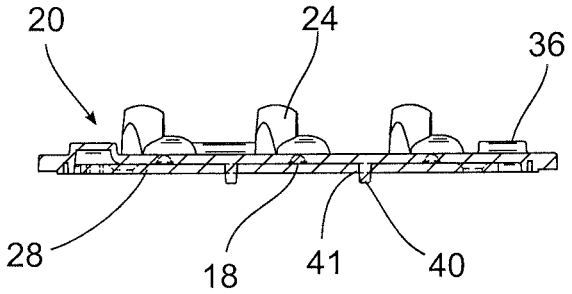
FIG. 11 is a sectional view of the optical array of FIG. 4 taken along line 11-11.

FIGS. 10 and 11 illustrate a cross-section of the optical array 20. As shown, each lens 24 includes a cavity 44 in which a corresponding LED 18 is accommodated. Further, clearance portions 36 are formed as embossments and each creates a bubble-like enclosure in which wires, connectors, or other electrical components can reside when optical array 20 is installed. According to the embodiment shown, the bottom side of optical array 20 contacts the upper side of PCB 28 when optical array 20 is installed. It is noted that according to one or more embodiments the pressure exerted by optical array 20 on PCB 28 when screws 22 are secured is sufficient to maintain adequate contact between the PCB 28 and base 14. That is, in certain embodiments a cavity in the underside of optical array 20 is sized such that PCB 28 fits snugly into the cavity and when screws 22 are fastened to base 14 the PCB 28 is forced into contact with the base and adequate heat transfer therebetween is enabled.

Figure 12:
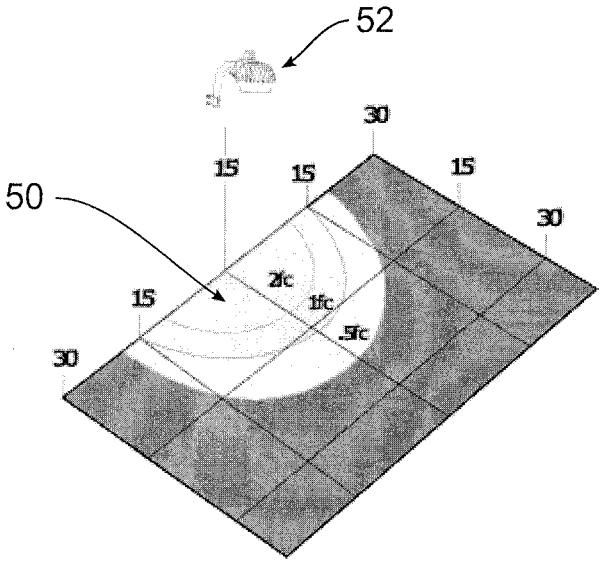
FIG. 12 is a diagram illustrating an outdoor luminaire emitting a symmetric illumination pattern.

LEDs emit light in all directions. When no optical array or secondary optic is provided that alters the emitted light pattern from the LEDs, or when spherical lenses are used in the optical array, a symmetric light pattern is emitted from a luminaire housing. FIG. 12 illustrates such a symmetric light pattern 50 emitted from a luminaire 52. In the embodiment shown in FIG. 12, a secondary optic is provided primarily to protect the LED light source from the exterior environment and does not alter the shape of the emitted light pattern. Thus, very little, if any, alteration to the light pattern emitted from the LEDs occurs. As a result, light is emitted downward from the luminaire 52 to create alight pattern 50 which is essentially circular in shape centered about an axis originating at the center of luminaire 52 and directed straight down to the ground. The circular light pattern 50 illuminates the ground equally in all directions, e.g., approximately a 20 foot radius from the axis in FIG. 12.

Figure 13:
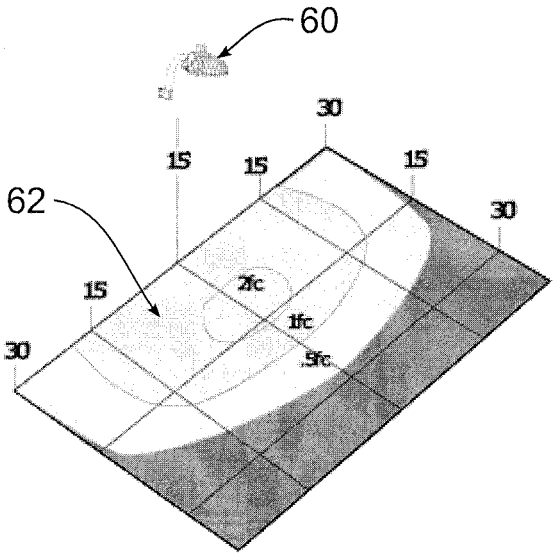
FIG. 13 is a diagram illustrating an outdoor luminaire emitting an asymmetric illumination pattern.
Figure 14:
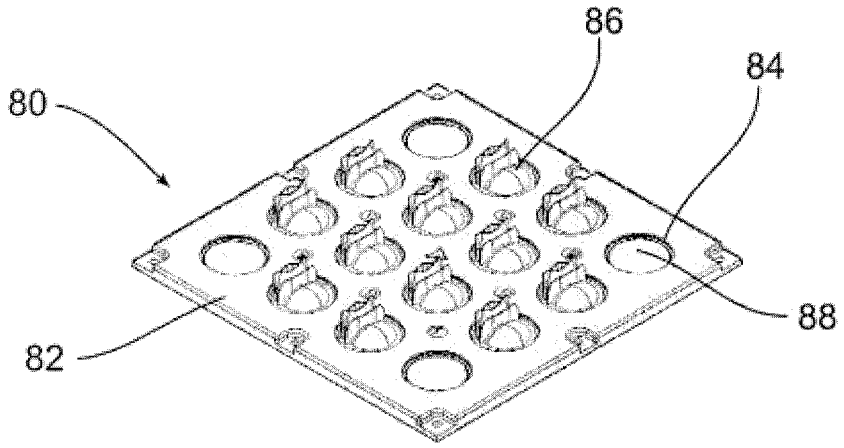
FIG. 14 is a top perspective view of another optical array in accordance with an exemplary embodiment.
Figure 15:
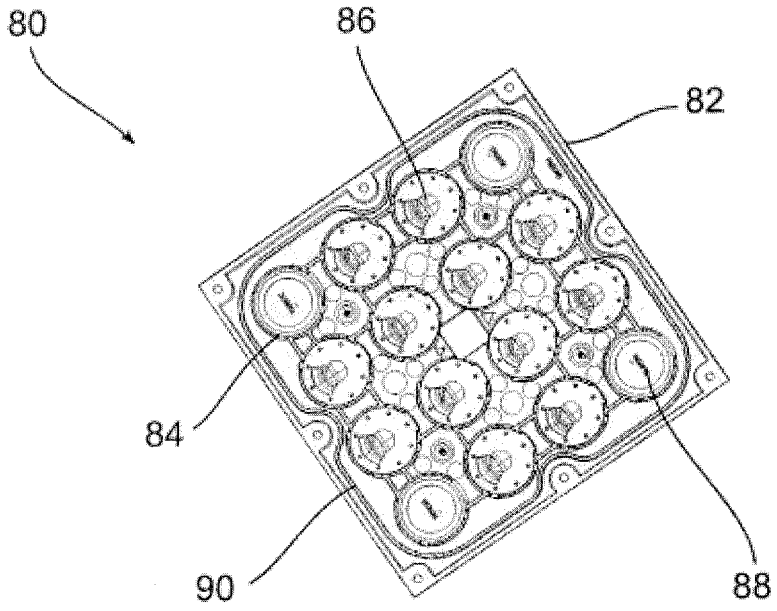
FIG. 15 is a bottom perspective view of the exemplary optical array of FIG. 14.
Figure 16:
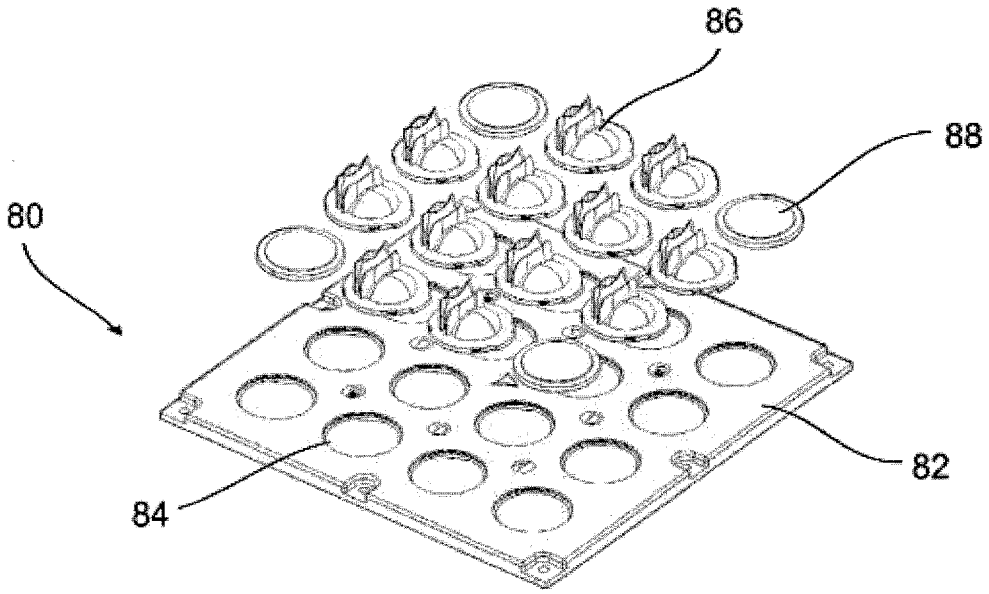
FIG. 16 is an exploded view of the exemplary optical array of FIG. 14.

FIG. 13 shows a luminaire 60 that utilizes an optical array 20 to emit a rectangular pattern of light 62 on the ground. It may become desired, however, to rotate the emitted light pattern 62 by 90 degrees without reconfiguring or moving the luminaire 60 or the light source. That is, making the emitted light pattern longer in the direction in front of and away from the luminaire 60 as opposed to longer in the direction on either side of luminaire 60, as shown in FIG. 13. Movement and rotation of the optical array 20 by 90 degrees would rotate light pattern 62 by 90 degrees.

For the various exemplary embodiments shown, the lenses 24 of the optical array 20 are all identical, that is, they each direct light in precisely the same manner. In alternative embodiments, there are no limitations on the similarity or difference between the individual lenses 24. Every individual lens 24 on a given optical array 20 can have a different shape and direct light in a different pattern or direction, and every lens 24 can be identically shaped, or any combination thereof, where some lenses 24 are the same and other lenses 24 are different. Furthermore, the optical array 20 itself is not limited to any particular shape, including round, oval, rectangular, polygonal, etc. As long as one or more lenses 24 align with corresponding one or more LEDs when the optical array is rotated the desired amount, the shape of the optical array is not limited.

According to the embodiments shown, optical array 20 is formed as a substantially square device which can be rotated easily in 90 degree increments to provide 4 independent light distributions from an array of LEDs 18. It is noted, however, that other configurations of the optical array and sizes of the array are also contemplated.

For example, an octagonal optical array, i.e., having eight sides, can be provided where instead of 90 degree increments, the optical device can be rotated in 45 degree increments to provide eight different light pattern formations without the need to move the luminaire or adjust the light source. It is known that LED luminaire design and manufacturing often requires intense thermal management design where thermal grease and other conductive materials and devices are carefully designed and placed within the luminaire to ensure proper heat dissipation. It is, thus, undesirable to disconnect or even adjust various heat conducting components after the luminaire is built and installed. By merely rotating the optical array 20, in accordance with embodiments of the present invention, the light distribution can be adjusted without interfering with the thermal management system in place.

Additionally, various numbers of LEDs 18 can be used. For example, any equal number of rows and columns can be used, such as, 3×3, as discussed above, 4×4, 5×5, etc. The arrangement of LEDs 18 should allow for the rotation of the optical array 20 to permit each respective lens 24 to mate with a corresponding LED 18.

Figure 17:
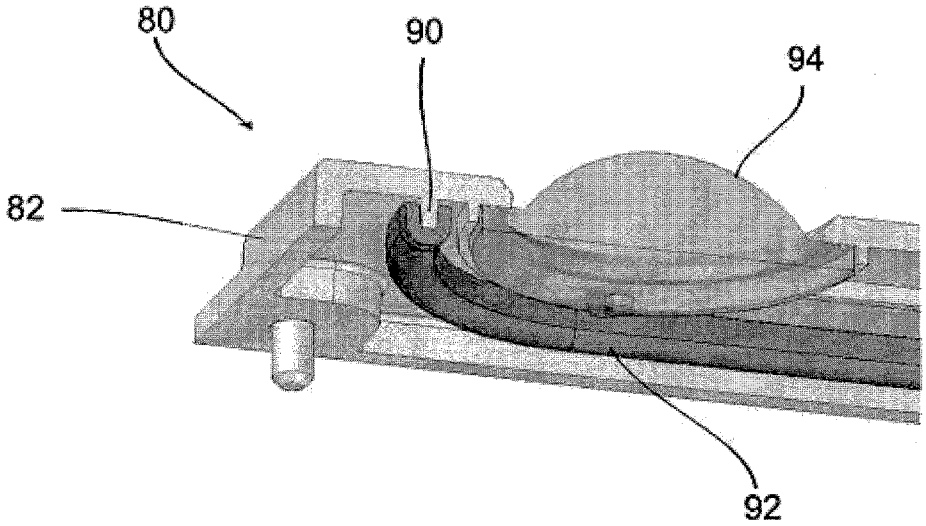
FIG. 17 is an enlarged, sectional view of the exemplary optical array of FIG. 14.

FIGS. 14-17 depict another exemplary optical array 80 that includes a body 82 having a plurality of openings 84. Separate lenses 86 and plugs 88 can be installed in the array 80 as needed. According to this embodiment, any number of independent lenses 86 can be incorporated into the optical array 80 to generate a desired light pattern. The lenses can have any type of size, shape, and configuration to create a desired light output. The plugs 88 are connected to openings that would not include a lens 86. A best shown in FIG. 17, the bottom of the base includes a ridge 90 for receiving a gasket 92. FIG. 17 also shows an alternative type of spherical lens 94 that can be used in various exemplary embodiments. The lenses 86, 94 and plugs 88 can be connected to the base 82 by any suitable manner, for example sonic welding.

In an exemplary embodiment, the base 82 and the plugs 86 are substantially opaque, allowing the light emitted from the LEDs 18 to be focused solely by the lenses 86. Different types of lenses can be used and in different patterns and orientations to provide a desired light output. This versatility can provide an advantage over a single-piece optical array and lens assembly, which require a separate molded part to create certain light out puts as opposed to a single base 82 that can be used with different lenses 86.

As used in this application, the terms "front," "rear," "upper," "lower," "upwardly," "downwardly," and other orientational descriptors are intended to facilitate the description of the exemplary embodiments of the present invention, and are not intended to limit the structure of the exemplary embodiments of the present invention to any particular position or orientation. Terms of degree, such as "substantially" or "approximately" are understood by those of ordinary skill to refer to reasonable ranges outside of the given value, for example, general tolerances associated with manufacturing, assembly, and use of the described embodiments.

What is claimed:

1. A lighting device comprising:

a housing having a base;

a plurality of light emitting devices connected to the base for producing a light output; and an optical array having a body and a plurality of lenses extending from the body, wherein the body is removably connected to the base, and wherein the optical array produces an asymmetrical light output and is repositionable on the base to modify the light output.

2. The lighting device of claim 1, wherein a single lens corresponds to each light emitter.

3. The lighting device of claim 2, wherein the optical array can be repositioned without movement of the light emitting device.

4. The lighting device of claim 1, wherein the optical array can be rotated a predetermined number of degrees, at least one of the lens portions corresponding to a different respective LED after the optical array element is rotated.

5. The lighting device of claim 4, wherein the optical array is rotatable in a minimum of 90 degree increments.

6. The lighting device of claim 1, wherein the optical array includes an indexing post and the light emitting device includes an indexing hole for receiving the indexing post.

7. The lighting device of claim 1, wherein the lenses are unitarily formed with the optical array.

8. The lighting device of claim 1, wherein the optical array includes an orientation marker.

9. An optical array for a lighting device comprising:

a body portion; and a plurality of lenses extending from the body portion, each lens having a cavity for receiving a light emitter, wherein the plurality of lenses combine to produce an asymmetric light output and the body portion is capable of being rotated to change the direction of the light output.

10. The optical array of claim 9, wherein the body portion and the lenses are unitarily formed.

11. The optical array of claim 9, wherein the lenses are connected to the body portion.

12. The optical array of claim 11, wherein a plug is connected to the body portion.

13. The optical array of claim 12, wherein the lenses and the plug are sonically welded to the body portion.

14. The optical array of claim 9, wherein the body includes a clearance portion and an orientation marker.

15. The optical array of claim 9, wherein the body has a substantially square configuration.

16. The optical array of claim 9, wherein the lenses are identical.

17. A method for altering the light emission pattern of an LED luminaire comprising:

removing an optical array from a housing of a luminaire having a light emitter with a first LED and a second LED, the optical array having a lens associated with the first LED and an asymmetric light output;

rotating the optical array relative to the first and second LEDs, wherein the first lens aligns with the second LED after the optical array is rotated; and connecting the optical array to the housing.

18. The method of claim 17, further comprising aligning one or more indexing elements disposed on the optical array element with one or more corresponding indexing holes.

19. The method of claim 17, wherein the optical array produces an asymmetrical light pattern and rotating the optical array changes the orientation of the light pattern.

20. The method of claim 17, wherein the optical array is rotatable in increments of 90 degrees.

* * * * *